United States Patent [19]

Bemmerl

[11] 3,992,888

[45] Nov. 23, 1976

[54] HYDRAULIC PIT PROP

[75] Inventor: Hans-Ferdinand Bemmerl, Herne, Germany

[73] Assignee: Bochumer Eisenhutte Heintzmann & Company, Bochum, Germany

[22] Filed: Apr. 8, 1976

[21] Appl. No.: 675,054

[30] Foreign Application Priority Data

Apr. 15, 1975 Germany ..... 2516394

[52] U.S. Cl. ..... 61/45 D; 248/357

[51] Int. Cl.[2] ..... E21D 15/44

[58] Field of Search ..... 61/45 D; 299/31–33; 248/357; 91/170 MP

[56] References Cited

UNITED STATES PATENTS

| | | | |
|---|---|---|---|
| 2,910,282 | 10/1959 | Barrett | 61/45 D |
| 3,576,110 | 4/1971 | Warns | 61/45 D |
| 3,739,586 | 6/1973 | Wehner et al. | 61/45 D |

FOREIGN PATENTS OR APPLICATIONS

| | | | |
|---|---|---|---|
| 1,340,014 | 9/1963 | France | 61/45 D |
| 845,302 | 8/1960 | United Kingdom | 61/45 D |

*Primary Examiner*—Dennis L. Taylor
*Attorney, Agent, or Firm*—Michael J. Striker

[57] ABSTRACT

A pit prop comprises an elongated skid adapted to lie on the floor and having a front end linkable to a support such as a face conveyor. A pair of generally parallel elongated feet flank the skid and each have a front portion which is substantially twice as wide as its rear portion. A slide fluid cylinder has a rear end secured to the rear end of the skid and a front end secured to a cross member attached to the front portions of the feet so that extension or contraction of the slide cylinder displaces the feet relative to the support. A pair of support arms each have a rear end loosely pivoted on the rear portion of the respective foot and a front end carrying a roof-engaging shield. A lift cylinder extends between each foot front portion and the respective front end of the respective arm for pressing the shield against the mine roof and the feet against the mine floor.

10 Claims, 4 Drawing Figures

HYDRAULIC PIT PROP

BACKGROUND OF THE INVENTION:

The present invention relates to a pit prop. More particularly this invention concerns such a pit prop used in the face-working of a coal seam or the like.

A pit prop is known having a pair of longitudinally extending parallel feet which have front ends turned toward the face being worked and rear ends on which are pivoted a roof support or shield. A lift cylinder, normally of the hydraulic type, can raise the roof shield relative to the feet and press it tightly against the mine roof, simultaneously pressing the feet against the mine floor so as to lock the pit prop tightly in place. A support, normally a face conveyor, extends along the face in front of a row of such pit props and each pit prop has a central skid that is pivoted on this support and which is connected via a hydraulic slide ram to the feet. Thus the feet can be moved relative to the support when the lift cylinder is relaxed and the support can be moved relative to the feet when the shield is pressed against the ceiling.

Typically the floor-engaging feet of such a pit prop are of generally regular or uniform cross-section. These feet flank the above-mentioned skid which substantially fills the space between them. Thus material that falls down between the feet is compressed and cannot work its way backward of the prop into the back fill. Furthermore this compacted deposit which forms between the feet makes it relatively difficult to displace the pit prop toward the face as this face is cut away.

Furthermore this relatively limited play between the central skid and the two feet of the prop makes the entire roof prop assembly relatively rigid. In particular the stresses exerted on the skid must be taken up by the pivots on this skid. For this reason the various joints must be over-dimensioned in order to prevent breaking down of the arrangement.

In addition the relatively wide rear portions of the feet force the respective arms carrying the roof-engaging shield to pivot about axes which are fixed in these feet. Thus unevenness in the mine roof or torsion caused by twisting of the lower portion from forces exerted by the face conveyor can load these rear-end pivots considerably. Once again these pivots must be overdimensioned. Since the prop is used well under ground it is essential that it have a very long service life, as servicing it is almost impossible without removing the relatively bulky item completely from the mine.

Summary of the Invention

It is therefore an object to provide an improved pit prop.

Another object of this invention is to provide such a pit prop which can move relatively easily toward and away from the working face.

Yet another object is the provision of a pit prop wherein the various parts can be displaced limitedly relative to one another without damage.

These objects are attained according to the present invention in a pit prop of the above-described general type wherein each of the elongated and generally parallel floor-engaging feet that flank the central skid has a front portion which is substantially wider than its rear portion. In accordance with this invention the rear portion of each foot is between one-half and one-third narrower than the respective front portion. Furthermore each rear portion has a length longitudinally of the respective foot which is between one-third and two-thirds, preferably about one-half of the overall length of the respective foot.

With the system according to the present invention a relatively large empty space is left between the rear portions and the central skid. Thus material that falls in this space can work its way back into the stowage area so that displacing of the pit prop will be much easier as it is not hindered by a pile of compacted dirt and refuse.

In accordance with further features of this invention the roof support is formed by a pair of arms on whose front end is pivoted a roof shield and whose rear ends are secured via relatively loose pivots to the rear portions of the respective feet, these loose pivots permitting limited twisting of the arm relative to its foot.

According to yet another feature of this invention relatively loose links are provided between the front end of the skid, the rear end of the skid and the rear end of the slide cylinder, the front end of the slide cylinder and the cross piece that connects the two feet together, and the ends of this cross piece and the feet. Thus a relatively loose assembly is made wherein limited twisting and shifting of the parts relative to one another can take place without damage or even serious strain to the assembly. Thus the danger of the prop breaking or ceasing to function is greatly reduced.

In accordance with the present invention the rear end of each foot or of each arm is formed with a horizontal throughgoing hole of hourglass or hyperboloidal shape and a cylindrical pin formed on the corresponding rear portion of the other element fits through this hole and constitutes the above-mentioned relatively loose pivot. Since in such arrangements the face conveyor tends to creep along the face slightly as the coal plow or the like cuts into the seam, such an arrangement allows the support constituted by this face conveyor to move without damage to the arrangement.

In accordance with yet another feature of this invention each rear portion is of generally regular section. Furthermore each front portion may be of also regular section and joined to the rear portion by a pair of straight edges. It is also within the scope of this invention to form the front portion of each foot with outwardly convex arcuate sides which may be continuous smooth curves or formed of a succession of short straight sections.

In accordance with the present invention the front ends of the feet are rounded off and laterally beveled so that they can easily slide skid-fashion along the ground when the respective foot shield has been dropped down and the slide cylinder is retracted.

With the system according to the present invention the disadvantageous transmission of forces from the face conveyor back to the pit prop is largely eliminated. Thus the various vibrations and forces that are normally passed from the face conveyor to the pit prop and can frequently can lead to loosening of these pit props and creation of a potentially dangerous situation are largely avoided. In particular when a hob-type coal cutter is employed carried on the face conveyor does this problem require constant supervision of the pit props in order to insure that these vibrations do not loosen them.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

Figure 1:
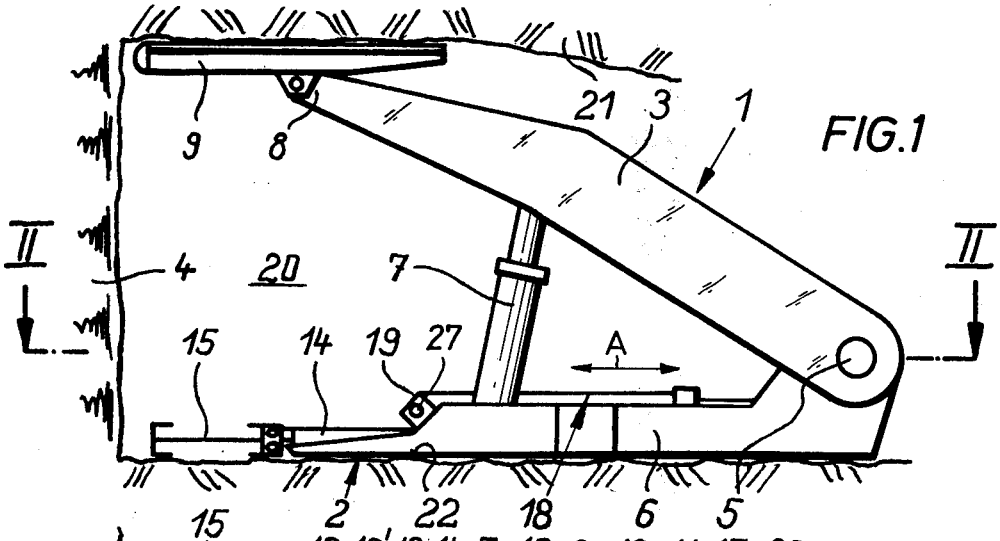
FIG. 1 is a side view of a pit prop according to this invention.
Figure 2:
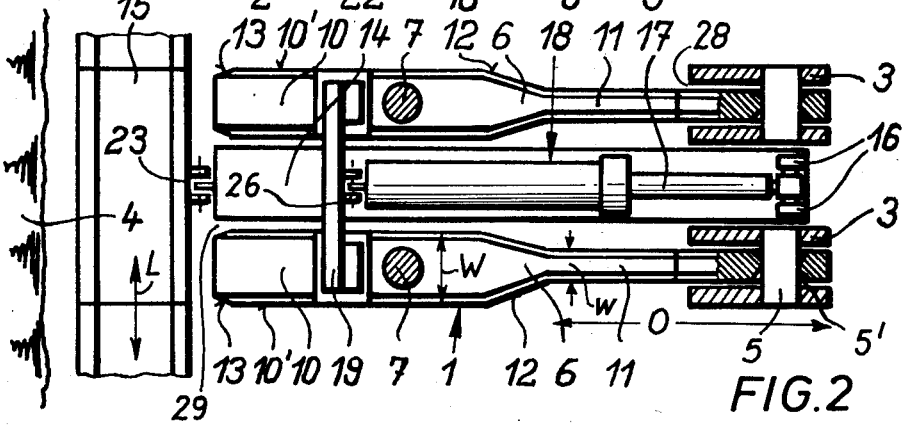
FIG. 2 is a section taken along line II—II of FIG. 1.

DESCRIPTION OF THE PREFERRED EMBODIMENTS:

A pit prop 1 as shown in FIGS. 1 and 2 is employed in a pit 20 between the roof 21, the floor 22, and the working face 4 thereof. In known manner a face conveyor 15 runs along the working face 4 in a direction indicated by arrow L. The pit prop 1 is displaceable in a direction A transverse to this direction L, usually to move it toward the face 4 which is constantly being cut away and away from the storage area behind the pit prop 1.

This prop 1 comprises a floor-engaging portion 2 and a roof support 3. The floor-engaging portion comprises a pair of parallel feet 6 having front portions 10 of width W and rear portions 11 with *w*, *w* being here equal to 0.4W. The front and rear portions 10 and 11 are of regular width and are joined by an intermediate portion 12. In addition the rear portions 11 have a length D in the direction A which is equal to slightly less than one-half the overall length in this direction of the respective foot 6. In addition the front edges of the seat 6 are chambered as shown at 13 and the edges are all bevelled so that these feet may slide readily along the floor 22.

The roof-support arms 3 have front ends 8 on which is pivoted a common roof shield 9 that bridges these front ends 8. In addition the back end of each of the arms 3 is secured by means of a pivot pin 5 to the respective rear portions 11. These rear portions 11 are to this end formed with hourglass-shaped or hyperberloidal throughgoing pivot holes 5' through which pass the pins 5. It is noted that the arms 3 are formed as downwardly open channels whose side portions flank the respective rear portion with a limited amount of play as indicated at 28. Thus these arms 3 can twist limitedly relative to the feet 6 without damage to either of them.

Each foot 6 is provided with a heavy-duty hydraulic ram 7 that engages between it and the respective arm 3 so as to force the shield tightly against the roof 21 and the feet tightly against the floor 22.

A skid 14 extending substantially the full length in direction A between the feet 6 is spaced from these feet 6 by a play 29 and has a front end secured via a loose pivot 23 to the conveyor 15. Its rear end is secured via another loose pivot 16 to the piston rod 17 of a hydraulic ram 18 whose front end in turn is secured via a loose pivot 26 to a cross member 19 in turn secured via loose pivots 27 to the feet 6. This ram 18 extends in the direction A and can, therefore, on expansion and contraction displace the prop 1 in this direction. During a normal mining operation the face 4 is continuously cut away by a hob or coal plow. It is therefore necessary to continuously move the conveyor 15 toward the face 4 and the props 1 also toward this face 4. The conveyor 15 is connected via the pivots 23 to a plurality of these props 1 and can therefore be moved relatively easily by contracting the cylinders 18 of all the props 1 when they are tightly engaged between the roof 21 and floor 22. When the face conveyor 15 is in the desired position the cylinders 18 of the props 1 are all locked. Then prop 1 may be displaced by relaxing its cylinders 7 to drop down the shield 9, and then expanding its cylinder 18 to push on the cross-piece 19 and slide the skid feet 6 forwardly. Since the face conveyor 15 is held tightly in place by the other props this face conveyor therefore forms a rigid support relative to which the prop 1 can move. Once the desired position is attained the cylinder 18 is locked and the cylinders 7 are expanded to secure the prop 1 tightly in place between the ceiling 21 and floor 22. The other props can be moved one by one in this same manner.

Figure 3:
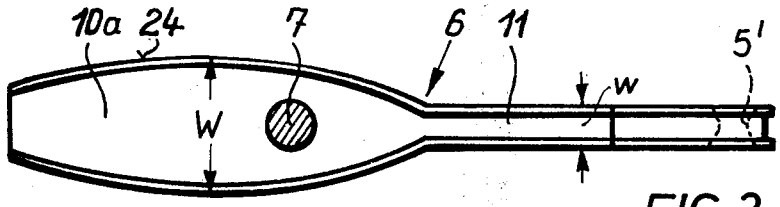
FIGS. 3 and 4 are top view of different skid feet usable with the pit prop shown in FIG. 1.

It is also possible as shown in FIG. 3 to form the feet 6 with front portions 10a with outwardly convex smooth arcuate surfaces 24. In this case the width W of the front portions 10a at their widest is equal to approximately three times the width *w*.

Figure 4:
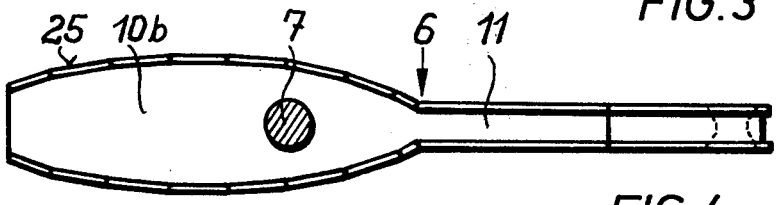

FIG. 4 shows an arrangement similar to FIG. 3 but wherein the front portions 10b have outwardly convex surfaces formed by a plurality of short straight sections 25. The feet 6 of FIGS. 3 and 4 greatly facilitate sliding of the lower portion 2 along the floor 22. Furthermore the relatively wide space between the rear portions 11 allows considerable twisting and shifting of the various parts relative to one another without damage.

It will be understood that each of the elements described above, or two or more together, may also find a useful application in other types of structures differing from the types described above.

While the invention has been illustrated and described as embodied in a pit prop, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pit prop comprising: a central elongated skid adapted to lie on the floor and having a front end securable to a support; a pair of generally parallel elongated feet flanking said skid and each having a front portion adapted to be turned toward a working face and of predetermined width and a rear portion adapted to be turned away from said face and of predetermined width substantially smaller than the width of said front portion; a slide fluid cylinder having one end secured to said front portions and another end secured to said skid, whereby extension or contraction of said slide cylinder displaces said feet relative to said skid; a roof support having a shield engageable against the roof and a rear end pivoted on said rear portions of said feet; and a lift fluid cylinder on each of said front portions and each engaging said roof support, whereby extension of said lift cylinders can press said shield tightly against said roof.

2. The prop defined in claim 1, wherein said rear portions are each between one-half and one-third narrower than the respective front portions.

3. The prop defined in claim 2, wherein said rear portions are each of a length longitudinally of the respective feet which is equal to between one-third and two-thirds of the overall length of the respective foot.

4. The prop defined in claim 3, wherein each rear portion is of generally regular width and is generally half as long as the respective foot.

5. The prop defined in claim 3, wherein said front portions are each of generally regular width.

6. The prop defined in claim 5, wherein each of said feet has an intermediate portion with a pair of straight outer edges each extending between a respective rear portion and the respective front portion.

7. The prop defined in claim 4, wherein each front portion has a pair of arcuate lateral sides.

8. The prop defined in claim 7, wherein each of said sides is formed of a succession of short straight sections.

9. A pit prop comprising: an elongated skid adapted to lie on the floor and having a front end linkable to a support; a pair of generally parallel elongated feet flanking said skid and each having a front portion adapted to be turned toward a working face and of predetermined width and a rear portion adapted to be turned away from said face and of a width equal to about half the width of said front portion; a slide fluid cylinder having a rear end secured to said rear end of said skid and a front end; a cross member attached to said front portions and to said front end of said slide cylinder, whereby extension or contraction of said slide cylinder displaces said feet relative to said support; a pair of support arms each having a front end and a rear end; a pivot between the rear end of each support arm and a respective rear portion and permitting limited relative twisting between each arm and the respective foot; a roof-engaging shield pivotal on said front ends of said arms; and a lift cylinder between each front portion and the respective front end of the respective arm.

10. The prop defined in claim 1, wherein each rear portion has a length equal to generally half the overall length of the respective foot and each rear portion is of substantially regular width.

* * * * *